US006625999B1

(12) United States Patent
Hu et al.

(10) Patent No.: US 6,625,999 B1
(45) Date of Patent: Sep. 30, 2003

(54) COOLING SYSTEM TEMPERATURE CONTROL METHOD AND APPARATUS

(75) Inventors: Ziqiang Hu, Prospect, KY (US); Alexander Rafalovich, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/113,893

(22) Filed: Mar. 29, 2002

(51) Int. Cl.[7] ..... F25D 17/04; F25D 11/02
(52) U.S. Cl. ..... 62/186; 62/441
(58) Field of Search ..... 62/186, 208, 209, 62/213, 441, 443

(56) References Cited

U.S. PATENT DOCUMENTS 5,176,006 A * 1/1993 Ikawa et al. ..... 62/125
5,743,104 A * 4/1998 Kim et al. ..... 62/209
6,006,533 A * 12/1999 Seol ..... 62/228.1
6,029,119 A 2/2000 Atkinson
6,348,777 B1 2/2002 Brown et al.
6,349,554 B2 2/2002 Patel et al.

* cited by examiner

*Primary Examiner*—Marc Norman
(74) *Attorney, Agent, or Firm*—Armstrong Teasdale LLP

(57) ABSTRACT

A method for controlling a cooling system configured to cool a compartment is provided. The method includes receiving a temperature of the compartment from a temperature sensor, adjusting the received temperature to obtain a corrected temperature, and controlling the cooling system based on the corrected temperature

23 Claims, 2 Drawing Sheets

COOLING SYSTEM TEMPERATURE CONTROL METHOD AND APPARATUS

BACKGROUND OF THE INVENTION

This invention relates generally to sealed system refrigeration devices, and more particularly, to control systems for refrigerators.

Typical refrigerators includes a fresh food compartment and a frozen food compartment. A temperature sensor is typically located in walls of both compartments and sends indications of the sensors temperature to a control unit which controls a compressor and a plurality of fans for cooling the compartments.

However, the temperature of the sensor is not typically the same as the temperature of the air within each compartment. Rather the wall in which the sensor is mounted effects the temperature of the sensor. For example, if a sensor in the fresh food compartment is mounted in a mullion which is a common wall between the fresh food compartment and the frozen food compartment, the sensor is at a temperature cooler than the air within the fresh food compartment. Alternatively, if a sensor is mounted in an exterior wall, then the sensor is typically warmer than the air within the fresh food compartment. Both of these two phenomenons are attributable to heat transfer through the wall in which the sensor is mounted. Therefore, the temperature sent to the control unit can vary from the true temperature of the air within a compartment.

BRIEF DESCRIPTION OF THE INVENTION

In one aspect, a method for controlling a cooling system configured to cool a compartment is provided. The method includes receiving a temperature of the compartment from a temperature sensor, adjusting the received temperature to obtain a corrected temperature, and controlling the cooling system based on the corrected temperature.

In another aspect, a cooling device includes a first compartment comprising a plurality of first walls and at least one first door defining a first enclosed volume of the first compartment. A sealed system configured to provide cooling capacity to the first compartment is operationally coupled to the first compartment and at least one first temperature sensor is coupled to at least one of the first walls and at least partially exposed to the first enclosed volume. A temperature control system is operationally coupled to said the temperature sensor and to the sealed system. The control system is configured to receive a temperature sensor reading from the first temperature sensor, and to control a temperature of the first compartment with the sealed system based on the temperature sensor reading and a correction factor.

In a further aspect, a refrigerator includes a first compartment configured to preserve food, the first compartment includes a plurality of first walls and at least one first door defining a first enclosed volume of the first compartment. The refrigerator also includes a second compartment configured to preserve food coupled to one of the first walls, the second compartment includes a plurality of second walls and at least one second door defining a second enclosed volume of the second compartment with one of the first walls. A sealed system is operationally coupled to the first and second compartments. The sealed system is configured to provide cooling capacity to the first and second compartments. At least one first temperature sensor is coupled to at least one of the first walls and at least partially exposed to the first enclosed volume. A temperature control system is operationally coupled to the first temperature sensor and to the sealed system. The control system is configured to receive a temperature sensor reading from the first temperature sensor, and to control a temperature of the first compartment with the sealed system based on the temperature sensor reading and a correction factor.

In yet another embodiment, a refrigerator includes a first compartment configured to preserve food, the first compartment includes a plurality of first walls and at least one first door defining a first enclosed volume of the first compartment. The refrigerator also includes a second compartment configured to preserve food coupled to one of the first walls, the second compartment includes a plurality of second walls and at least one second door defining a second enclosed volume of the second compartment with one of the first walls. A sealed system is operationally coupled to the first and second compartments, and the sealed system is configured to provide cooling capacity to the first and second compartments. At least one first temperature sensor is coupled to at least one of the first walls and at least partially exposed to the first enclosed volume. At least one second temperature sensor is at least partially exposed to the second enclosed volume. A temperature control system is operationally coupled to the first and second temperature sensors and to the sealed system. The control system is configured to receive a first temperature sensor reading from the first temperature sensor and receive a second temperature sensor reading from the second temperature sensor. The control system is also configured to control a first temperature of the first compartment with the sealed system based on the first temperature sensor and a correction factor that is a function of temperature difference between the first received temperature sensor reading and the second received temperature sensor reading. The control system is also configured to control a second temperature of the second compartment with the sealed system based on the second temperature sensor and a correction factor that is a function of temperature difference between the first received temperature sensor reading and the second received temperature sensor reading, wherein the second temperature is different from said first temperature.

DETAILED DESCRIPTION OF THE INVENTION

Figure 1:
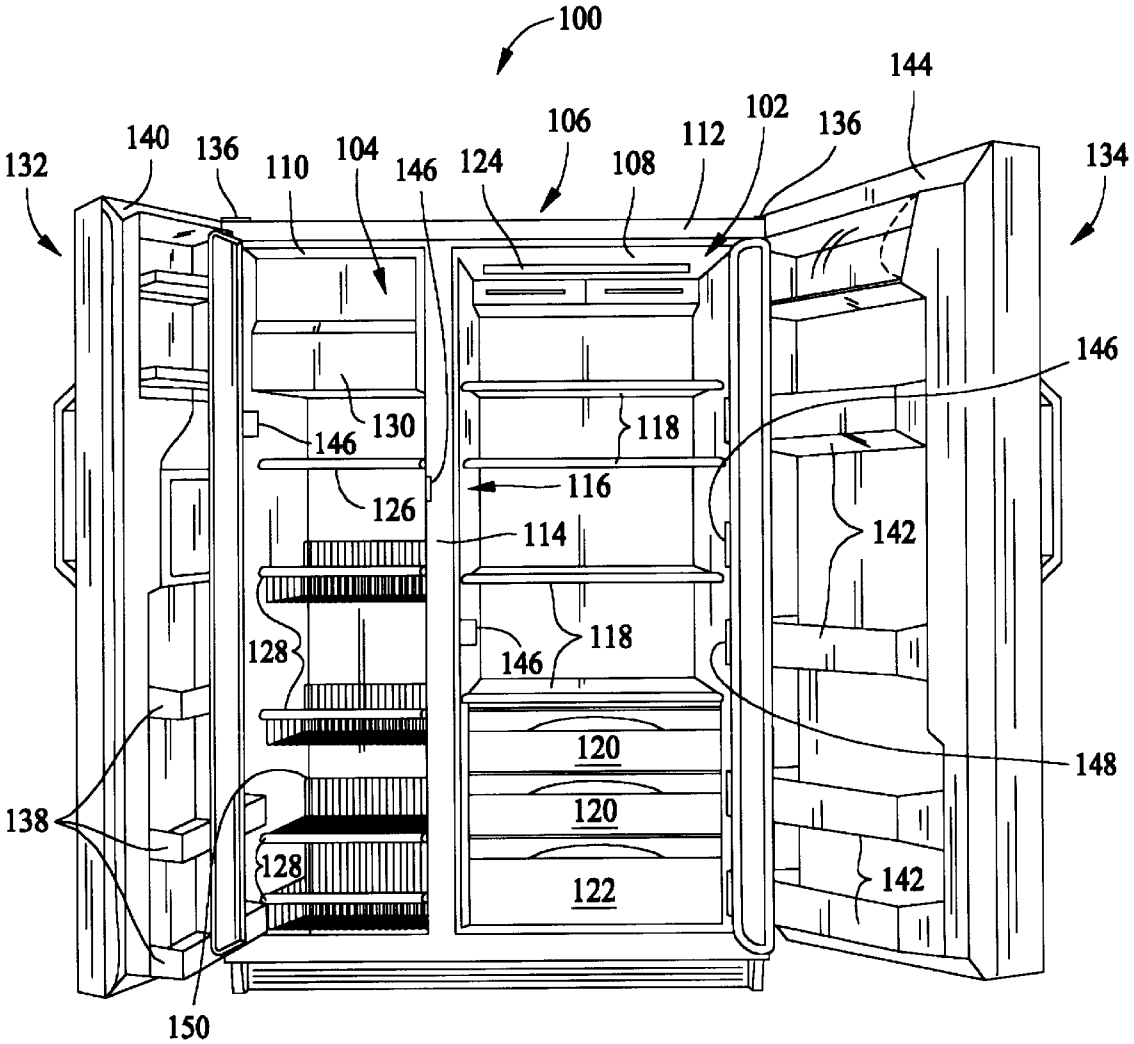
FIG. 1 is a perspective view of an exemplary refrigerator.

FIG. 1 illustrates a side-by-side refrigerator 100 in which the present invention may be practiced. It is recognized, however, that the benefits of the present invention apply to other types of refrigerators, freezers, refrigeration appliances, and refrigeration devices, including climate control systems having similar control issues and considerations such as, for example, but not limited to, one compartment units, three compartment units, units with any number of compartments, commercial units including vending units, and residential units. Consequently, the description set forth herein is for illustrative purposes only and is not intended to limit the invention in any aspect.

Refrigerator 100 includes a fresh food storage compartment 102 and a freezer storage compartment 104. Freezer compartment 104 and fresh food compartment 102 are arranged side-by-side in an outer case 106 with inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100.

Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-styrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. It will be understood that in a refrigerator with separate mullion dividing a unitary liner into a freezer and a fresh food compartment, a front face member of mullion corresponds to mullion 114. Breaker strip 112 and mullion 114 form a front face, and extend completely around inner peripheral edges of case 106 and vertically between liners 108, 110. Mullion 114, insulation between compartments 102, 104, and a spaced wall of liners 108, 110 separating compartments 102, 104 sometimes are collectively referred to herein as a center mullion wall 116.

Shelves 118 and slide-out drawers 120 normally are provided in fresh food compartment 102 to support items being stored therein. A bottom drawer or pan 122 partly forms a quick chill and thaw system (not shown) and selectively controlled, together with other refrigerator features, by a microprocessor (not shown) according to user preference via manipulation of a control interface 124 mounted in an upper region of fresh food storage compartment 102 and coupled to the microprocessor. A shelf 126 and wire baskets 128 are also provided in freezer compartment 104. In addition, an ice maker 130 may be provided in freezer compartment 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

In accordance with known refrigerators, refrigerator 100 also includes a machinery compartment (not shown) that at least partially contains components for cooling air. The cooled air is used to refrigerate one or more refrigerator or freezer compartments via fans (not shown). The construction of the cooling system components is well known and therefore not described in detail herein.

Refrigerator 100 includes a plurality of temperature sensors 146. In one embodiment, sensors 146 are thermistors. Alternatively, sensors 146 are thermocouples. Fresh food and freezer compartments 102, 104 each include a side wall 148, 150 respectively. Some sensors 146 are located on side walls 148 and 150 to avoid obstruction of compartments 102 and 104. Additionally, some sensors 146 are located in mullion 114. Although the purpose of sensors 146 are to sense the temperature of compartment 102 and 104, sensors 146 sense the temperature of the location where each sensor 146 is located. Sometimes the measured temperature will be different from the true temperature in compartments 102 and 104. Additionally, the measured temperature is also influenced by the temperatures and the temperature change on the other side of side walls 148 and 150 on or in which a particular sensor 146 is installed. For example, a sensor located in mullion 114 senses the temperature change on both fresh food compartment 102 and freezer compartment 104 because of heat transfer through mullion 114.

Therefore, to improve the accuracy of the temperatures in compartments 102 and 104, the temperature measurements from sensors 146 are corrected as described herein. The moving force of heat transfer through walls 148 and 150, doors 132 and 134, and mullion 114 is a temperature difference between the temperatures from both sides of the walls 148 and 150, doors 132 and 134, or mullion 114. With good accuracy, the heat flux Q may be described by the equation $Q=U*A*(T1-T2)$, where U is a heat transfer coefficient that combines the influence of the heat transfer resistance from air to both sides of walls 148 and 150, doors 132 and 134, or mullion 114 with the conductance of walls 148 and 150, doors 132 and 134, or mullion 114 material. A is the surface area, and T1 and T2 are temperatures from a sensor mounted to an exterior surface and a sensor mounted to an interior surface of a wall, wherein the interior surface is interior to the compartment being measured and the exterior surface is exterior to the compartment but not necessary exterior to refrigerator 100. For example, one sensor 146 is coupled to a surface of mullion 114 interior to fresh food compartment 102 and one sensor 146 is coupled to mullion 114 exterior to fresh food compartment 102 and interior to frozen food compartment 104. Also, in one embodiment, the two different compartments are both above freezing but at different temperatures.

Also the surface area each particular sensor 146 is exposed to is also constant. So, with good accuracy the heat flux Q is proportional to $dTw=T1-T2$ or $Q=Cw*dTw$ (equation 1), where Cw is a constant that depends on the refrigerator and thermal sensor cavity geometry, and where dTw represents the temperature difference between a first sensor interior a compartment and a second sensor exterior the compartment. The temperature influence (dTs) on each sensor 146 from heat flux Q can be calculated as $dTs=Q/(Us*As)$, where Us is the heat transfer coefficient from air to a particular sensor 146 and As is the sensor surface area exposed to the heat flux Q. During operation of the closed cooling system, sensors 146 do not move and therefore the areas As are constant. Although, airflow can influence the heat transfer coefficients Us, each sensor 146 is usually located in a cavity (not shown) with very small air movement within the cavity and changes in air movement within the cavity during a full cycle are not considerable. Therefore, Us also can be considered as a constant. Thus, $dTs=Q/Cs$ (equation 2), where Cs is a constant.

Combination of equations (1) and (2) results in $dTs=C*dTw$ (equation 3), where C is a constant combining two constants Cw and Cs. Constant C for each combination of sensors can be either calculated or found experimentally. The correction in the sensor temperature is done depending on the location of a particular sensor 146 and a difference between the temperatures from both sides of the wall. For any sensor(s) located in side walls 148 and 150, or doors 132 and 134, the sensor temperature correction is proportional to the difference between ambient temperature and the temperature of compartments 102 or 104.

For sensor(s) located in mullion 114, the sensor temperature correction is proportional to the difference between temperatures in adjacent compartments 102 and 104. The temperatures in compartments 102 and 104 are known. Thus, for any sensor(s) 146 located in mullion 114, there is no need for any additional temperature measurement. In other words, each compartment has an associated target temperature, say 1° for freezer compartment 104 and 35° for fresh food compartment 102. The correction is then 34 times the constant coefficient. To correct the temperature from a sensor located in the walls or doors the ambient temperature is used. However, with an assumption that the ambient temperature in a kitchen is a constant the correction is calculated as $dTs=Cc*Tc+Ca$, where Cc and Ca are constants that can be determined by experiment. For example, fresh food compartment 102 has a target temperature of 38° and the ambient temperature is measured at 72°, then the correction factor is proportional to 72−38 which is 34. As used herein a target temperature is the temperature that the compartment is set to maintain.

Figure 2:
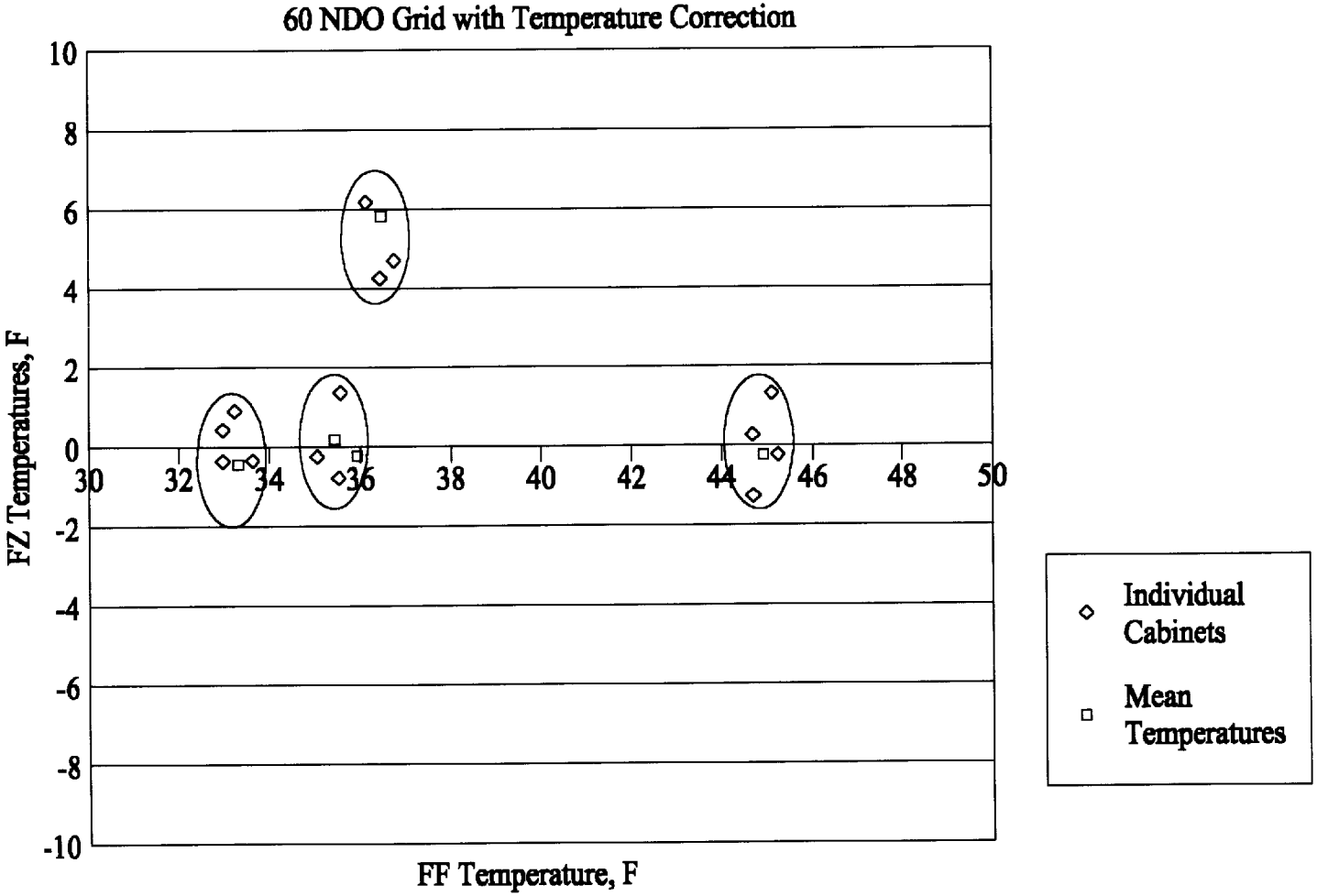
FIG. 2 illustrates test data of the refrigerator shown in FIG. 1.

FIG. 2 illustrates test data with the above described compensation of refrigerator 100. The accuracy of the temperature was significantly improved over refrigerators which do not compensate the sensor readings. Accordingly, a cost effective refrigerator is provided that economically compensates for the difference between the true temperature in a compartment and the measured temperature in the compartment. Additionally, while described in the context of sensors mounted in mullions and side walls of refrigerators, it is contemplated that the benefits of the invention accrue to all cooling devices having temperature sensors.

While the invention has been described in terms of various specific embodiments, those skilled in the art will recognize that the invention can be practiced with modification within the spirit and scope of the claims.

What is claimed is:

1. A method for controlling a cooling system configured to cool a compartment, said method comprising:

receiving a temperature of the compartment from a temperature sensor mounted in a side of a wall of the compartment;

adjusting the received temperature, to obtain a corrected temperature, with a correction factor that is a function of temperature difference between the recerved temperature and a temperature on a side of the wall opposite the side with the temperature sensor mounted thereon; and controlling the cooling system based on the corrected temperature.

2. A method for controlling a cooling system configured to cool a compartment, said method comprising:

receiving a temperature of the compartment from a temperature sensor mounted in an interior side of an exterior wall of the compartment;

adjusting the received temperature, to obtain a corrected temperature, with a correction factor that is a function of temperature difference between the received temperature and an ambient exterior temperature; and controlling the cooling system based on the corrected temperature.

3. A method for controlling a cooling system configured to cool a compartment, said method comprising:

receiving a temperature of the compartment from a temperature sensor mounted in an interior side of an exterior wall of the compartment;

adjusting the received temperature, to obtain a corrected temperature, with a correction factor that is a function of temperature difference between a target temperature and an ambient exterior temperature; and controlling the cooling system based on the corrected temperature.

4. A method for controlling a cooling system configured to cool a compartment, said method comprising:

receiving a temperature of the compartment from a temperature sensor mounted in a side of a wall of the compartment separating the compartment from a second compartment;

adjusting the received temperature, to obtain a corrected temperature, with a correction factor that is a function of temperature difference between the received temperature and a temperature sensed in the second compartment; and controlling the cooling system based on the corrected temperature.

5. A method in accordance with claim 4 further comprising:

adjusting the sensed temperature of the second compartment to obtain a second corrected temperature; and controlling the temperature of the second compartment based on the second corrected temperature.

6. A method in accordance with claim 5 wherein said controlling the temperature of the second compartment comprises controlling the temperature of the second compartment based on the second corrected temperature, wherein the second compartment is below freezing and the first compartment is above freezing.

7. A method for controlling a cooling system configured to cool a compartment, said method comprising:

receiving a temperature of the compartment from a temperature sensor mounted in a side of a wall of the compartment separating the compartment from a second compartment;

adjusting the received temperature, to obtain a corrected temperature, with a correction factor that is a function of temperature difference between a target temperature and a temperature sensed in the second compartment; and controlling the cooling system based on the corrected temperature.

8. A cooling device comprising:

a first compartment comprising a plurality of first walls and at least one first door defining a first enclosed volume of said first compartment;

a sealed system configured to provide cooling capacity to said first compartment operationally coupled to said first compartment;

at least one first temperature sensor coupled to at least one of said first walls and at least partially exposed to said first enclosed volume; and a temperature control system operationally coupled to said first temperature sensor and to said sealed system, said control system configured to:

receive a temperature sensor reading from said first temperature sensor; and control a temperature of said first compartment with said sealed system based on the temperature sensor reading and a correction factor by changing at least one operating parameter of the sealed system according to the temperature sensor reading and said correction factor, wherein said correction factor is a function of a temperature difference between the temperature sensor reading and a temperature of a temperature sensor mounted to a surface of said first wall coupled to said first temperature sensor, said surface exterior to said first compartment.

9. A device in accordance with claim 8 further comprising at least one fan configured to move air in said first compartment.

10. A cooling device comprising:

a first compartment comprising a plurality of first walls and at least one first door defining a first enclosed volume of said first compartment;

a sealed system configured to provide cooling capacity to said first compartment operationally coupled to said first compartment;

at least one first temperature sensor coupled to at least one of said first walls and at least partially exposed to said first enclosed volume;

a second compartment coupled to one of said first walls, said second compartment comprising a plurality of second walls and at least one second door defining a second enclosed volume of said second compartment with one of said first walls, at least one second temperature sensor coupled to said first wall coupled to said first sensor, said second sensor at least partially exposed to said second enclosed volume; and a temperature control system operationally coupled to said first temperature sensor, said second temperature sensor and to said sealed system, said control system configured to:

receive a temperature sensor reading from said first temperature sensor;

control a temperature of said first compartment with said sealed system based on the temperature sensor reading and a correction factor;

receive a temperature sensor reading from said second temperature sensor; and control a temperature of said second compartment with said sealed system based on the second temperature sensor reading and the first temperature sensor reading.

11. A device in accordance with claim 10 wherein said control device further configured to:

maintain said first compartment at a temperature above freezing; and maintain said second compartment at a temperature below freezing.

12. A device in accordance with claim 10 wherein said control device further configured to:

maintain said first compartment at a temperature above freezing; and maintain said second compartment at a temperature above freezing.

13. A cooling device comprising:

a first compartment comprising a plurality of first walls and at least one first door defining a first enclosed volume of said first compartment;

a sealed system configured to provide cooling capacity to said first compartment operationally coupled to said first compartment;

at least one first temperature sensor coupled to at least one of said first walls and at least exposed to said first enclosed volume; and a temperature control system operationally coupled to said first temperature sensor and to said sealed system, said control system configured to:

receive a temperature sensor reading from said first temperature sensor; and control a temperature of said first compartment with said sealed system based on the temperature sensor reading and a correction factor by changing at least one operating parameter of the sealed system according to the temperature sensor reading and said correction factor, wherein said correction factor is a function of a temperature difference between a target temperature and a temperature of a temperature sensor mounted to a surface of said first wall coupled to said first temperature sensor, said surface exterior to said first compartment.

14. A device in accordance with claim 13 further comprising:

a second compartment coupled to one of said first walls, said second compartment comprising a plurality of second walls and at least one second door defining a second enclosed volume of said second compartment with one of said first walls, at least one second temperature sensor coupled to said first wall coupled to said first sensor, said second sensor at least partially exposed to said second enclosed volume, said control system configured to:

receive a temperature sensor reading from said second temperature sensor; and control a temperature of said second compartment with said sealed system based on a target temperature of said second compartment.

15. A refrigerator comprising:

a first compartment configured to preserve food, said first compartment comprising a plurality of first walls and at least one first door defining a first enclosed volume of said first compartment;

a second compartment configured to preserve food coupled to one of said first walls, said second compartment comprising a plurality of second walls and at least one second door defining a second enclosed volume of said second compartment with one of said first walls;

a sealed system operationally coupled to said first and second compartments, said sealed system configured to provide cooling capacity to said first and second compartments;

at least one first temperature sensor coupled to at least one of said first walls and at least partially exposed to said first enclosed volume; and a temperature control system operationally coupled to said first temperature sensor and to said sealed system, said control system configured to:

receive a temperature sensor reading from said first temperature sensor;

control a temperature of said first compartment with said sealed system based on the temperature sensor reading and a correction factor; and adjust the received temperature with said correction factor that is a function of temperature difference between a target temperature and a temperature of a sensor mounted on a side of said first wall opposite a side with said first temperature sensor mounted thereon.

16. A refrigerator comprising:

a first compartment configured to preserve food, said first compartment comprising a plurality of first walls and at least one first door defining a first enclosed volume of said first compartment;

a second compartment configured to preserve food coupled to one of said first walls, said second compartment comprising a plurality of second walls and at least one second door defining a second enclosed volume of said second compartment with one of said first walls;

a sealed system operationally coupled to said first and second compartments, said sealed system configured to provide cooling capacity to said first and second compartments;

at least one first temperature sensor coupled to at least one of said first walls and at least partially exposed to said first enclosed volume; and a temperature control system operationally coupled to said first temperature sensor and to said sealed system, said control system configured to:

receive a temperature sensor reading from said first temperature sensor;

control a temperature of said first compartment with said sealed system based on the temperature sensor reading and a correction factor; and adjust the received temperature with said correction factor that is a function of temperature difference between the received temperature and a temperature on a side of said first wall opposite a side with said temperature sensor mounted thereon.

17. A refrigerator comprising:

a first compartment configured to preserve food, said first compartment comprising a plurality of first walls and at least one first door defining a first enclosed volume of said first compartment;

a second compartment configured to preserve food coupled to one of said first walls, said second compartment comprising a plurality of second walls and at least one second door defining a second enclosed volume of said second compartment with one of said first walls;

a sealed system operationally coupled to said first and second compartments, said sealed system configured to provide cooling capacity to said first and second compartments;

at least one first temperature sensor coupled to at least one of said first walls and at least partially exposed to said first enclosed volume; and a temperature control system operationally coupled to said first temperature sensor and to said sealed system, said control system configured to:

receive a temperature sensor reading from said first temperature sensor;

control a temperature of said first compartment with said sealed system based on the temperature sensor reading and a correction factor; and adjust the received temperature with said correction factor that is a function of a temperature difference between a target temperature and a temperature sensed in said second compartment.

18. A refrigerator comprising:

a first compartment configured to preserve food, said first compartment comprising a plurality of first walls and at least one first door defining a first enclosed volume of said first compartment;

a second compartment configured to preserve food coupled to one of said first walls, said second compartment comprising a plurality of second walls and at least one second door defining a second enclosed volume of said second compartment with one of said first walls;

a sealed system operationally coupled to said first and second compartments, said sealed system configured to provide cooling capacity to said first and second compartments;

at least one first temperature sensor coupled to at least one of said first walls and at least partially exposed to said first enclosed volume;

at least one second temperature sensor coupled to said first wall coupled to said first sensor, said second sensor at least partially exposed to said second enclosed volume; and a temperature control system operationally coupled to said first temperature sensor and to said sealed system, said control system configured to:

receive a temperature sensor reading from said first temperature sensor;

control a temperature of said first compartment with said sealed system based on the temperature sensor reading and a correction factor;

receive a temperature sensor reading from said second temperature sensor; and control a temperature of said second compartment with said sealed system based on the second temperature sensor reading and the first temperature sensor reading.

19. A refrigerator in accordance with claim 18 wherein said control further configured to:

maintain said first compartment at a temperature above freezing; and maintain said second compartment at a temperature below freezing.

20. A refrigerator in accordance with claim 18 wherein said control further configured to:

maintain said first compartment at a temperature above freezing; and maintain said second compartment at a temperature above freezing.

21. A refrigerator comprising:

a first compartment configured to preserve food, said first compartment comprising a plurality of first walls and at least one first door defining a first enclosed volume of said first compartment;

a second compartment configured to preserve food coupled to one of said first walls, said second compartment comprising a plurality of second walls and at least one second door defining a second enclosed volume of said second compartment with one of said first walls;

a sealed system operationally coupled to said first and second compartments, said sealed system configured to provide cooling capacity to said first and second compartments;

at least one first temperature sensor coupled to at least one of said first walls and at least partially exposed to said first enclosed volume;

at least one second temperature sensor coupled to said first wall coupled to said first sensor, said second sensor at least partially exposed to said second enclosed volume; and a temperature control system operationally coupled to said first temperature sensor and to said sealed system, said control system configured to:

receive a temperature sensor reading from said first temperature sensor;

control a temperature of said first compartment with said sealed system based on the temperature sensor reading and a correction factor;

receive a temperature sensor reading from said second temperature sensor; and control a temperature of said second compartment with said sealed system based on the second temperature sensor reading and a target temperature of said first compartment.

22. A refrigerator comprising:

a first compartment configured to preserve food, said first compartment comprising a plurality of first walls and at least one first door defining a first enclosed volume of said first compartment;

a second compartment configured to preserve food coupled to one of said first walls, said second compartment comprising a plurality of second walls and at least one second door defining a second enclosed volume of said second compartment with one of said first walls;

a sealed system operationally coupled to said first and second compartments, said sealed system configured to provide cooling capacity to said first and second compartments;

at least one first temperature sensor coupled to at least one of said first walls and at least partially exposed to said first enclosed volume;

at least one second temperature sensor at least partially exposed to said second enclosed volume;

a temperature control system operationally coupled to said first and second temperature sensors and to said sealed system, said control system configured to:

receive a first temperature sensor reading from said first temperature sensor;

receive a second temperature sensor reading from said second temperature sensor;

control a first temperature of said first compartment with said sealed system based on the first temperature sensor and a correction factor that is a function of temperature difference between the first received temperature sensor reading and the second received temperature sensor reading; and control a second temperature of said second compartment with said sealed system based on the second temperature sensor and a correction factor that is a function of temperature difference between the first received temperature sensor reading and the second received temperature sensor reading, said second temperature different from said first temperature.

23. A refrigerator in accordance with claim 22 wherein the first temperature is above freezing and the second temperature is below freezing.

* * * * *